US007048513B2

(12) United States Patent
Dukes et al.

(10) Patent No.: US 7,048,513 B2
(45) Date of Patent: May 23, 2006

(54) GAS PRESSURE DRIVEN FLUID PUMP HAVING COMPRESSION SPRING PIVOT MECHANISM AND DAMPING SYSTEM

(75) Inventors: Jon W. Dukes, Columbia, SC (US); Rickie A. Pendergrass, Rock Hill, SC (US); Drew L. Platts, Barnwell, SC (US); Jairo L. Soares, Sao Paulo (BR)

(73) Assignee: Spirax Sarco, Inc., Blythewood, SC (US)

( * ) Notice: Subject to any disclaimer, the term of this patent is extended or adjusted under 35 U.S.C. 154(b) by 0 days.

(21) Appl. No.: 10/729,355

(22) Filed: Dec. 5, 2003

(65) Prior Publication Data

US 2004/0151597 A1 Aug. 5, 2004

Related U.S. Application Data

(60) Provisional application No. 60/433,315, filed on Dec. 13, 2002.

(51) Int. Cl.
*F04F 1/06* (2006.01)

(52) U.S. Cl. ..... 417/133; 417/134

(58) Field of Classification Search ..... 417/126, 417/130, 131, 133, 134
See application file for complete search history.

(56) References Cited

U.S. PATENT DOCUMENTS

| | | | | |
|---|---|---|---|---|
| 753,861 | A | | 3/1904 | Duck |
| 1,314,244 | A | | 8/1919 | Brand |
| 1,322,324 | A | | 11/1919 | Mertens |
| 1,327,939 | A | | 1/1920 | Brightman |
| 1,666,573 | A | | 4/1928 | Krantz |
| 2,043,073 | A | | 6/1936 | Simpson |
| 2,961,880 | A | | 11/1960 | Griswold |
| 3,402,614 | A | | 9/1968 | Malette |
| 4,199,850 | A | * | 4/1980 | Velan ..... 29/890.129 |
| 5,141,405 | A | | 8/1992 | Francart, Jr. |
| 5,141,644 | A | * | 8/1992 | Forde ..... 210/512.1 |
| 5,401,142 | A | | 3/1995 | Yumoto |
| RE34,957 | E | | 5/1995 | Francart, Jr. |
| 5,426,990 | A | | 6/1995 | Francart, Jr. |
| 5,445,501 | A | | 8/1995 | Yumoto |

(Continued)

OTHER PUBLICATIONS

International Search report on corresponding PCT application, Serial No. PCT/US03/39095, international filing date Dec. 10, 2003.

*Primary Examiner*—Charles G. Freay
(74) *Attorney, Agent, or Firm*—Nelson Mullins Riley & Scarborough LLP

(57) ABSTRACT

A gas pressure driven fluid pump having a pump tank with a liquid inlet and a liquid outlet. A float assembly is carried within the interior of the pump tank and is movable between a low level position and a high level position. A compression spring is connected between the float assembly and a pivot member. Due to the force applied by the compression spring, the pivot member rotates to a first position when the float reaches its high level position and rotates to a second position when the float reaches its low level position. A valve assembly is connected to said pivot member to switch between motive porting and exhaust porting in a snap over fashion due to rotation of said pivot member between said first position and said second position. A damper system may be connected to the valve assembly to slow movement of the valve assembly between motive porting and exhaust porting.

33 Claims, 13 Drawing Sheets

U.S. PATENT DOCUMENTS 5,934,881 A 8/1999 Yumoto
5,938,409 A 8/1999 Radle, Jr. et al.
5,941,691 A 8/1999 Stephens
6,015,267 A 1/2000 Yumoto
6,244,828 B1 6/2001 Yumoto
6,244,829 B1 6/2001 Yumoto
6,503,064 B1 * 1/2003 Croke et al. ..... 417/326
6,572,340 B1 6/2003 Collins
6,599,096 B1 7/2003 Totten et al.
2002/0041808 A1 4/2002 Collins

* cited by examiner

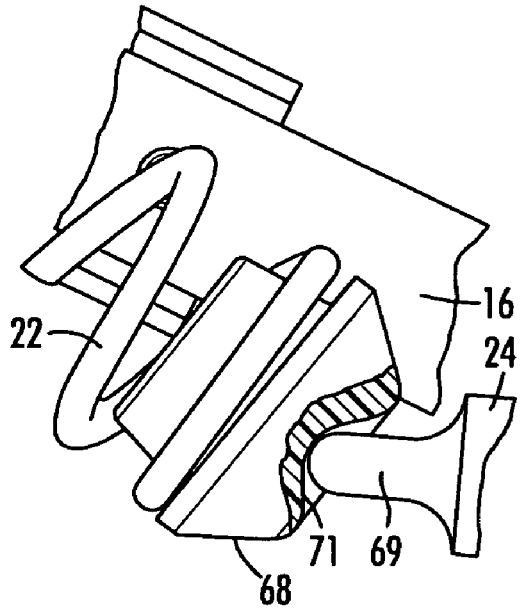
FIG. 13
FIG. 14
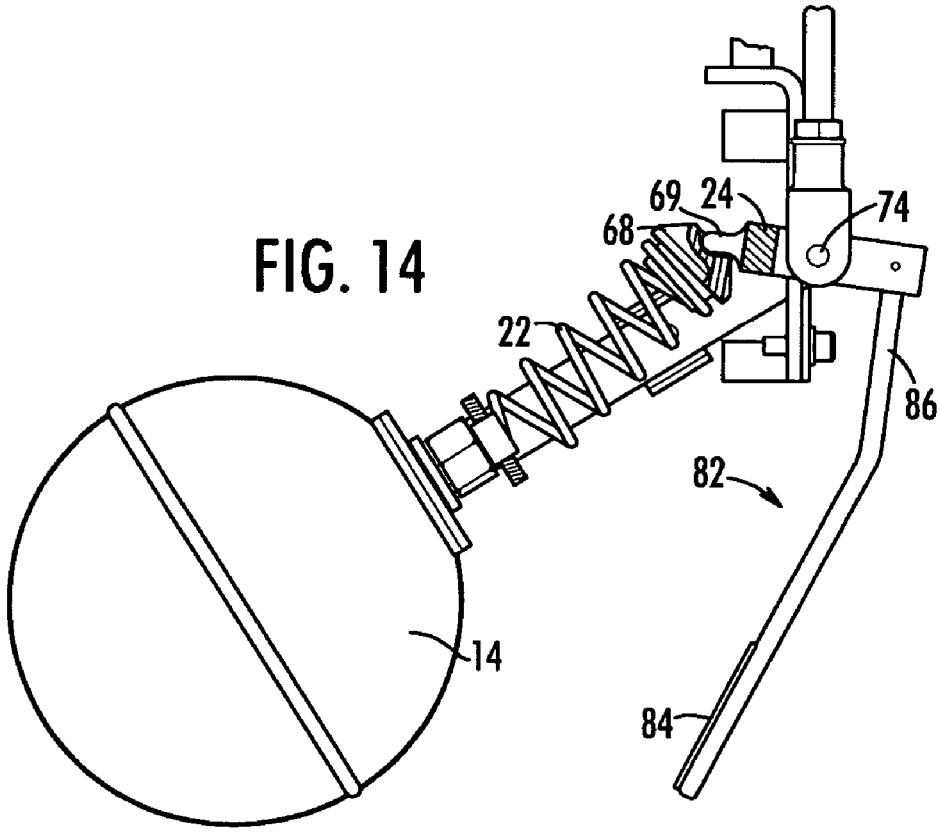

GAS PRESSURE DRIVEN FLUID PUMP HAVING COMPRESSION SPRING PIVOT MECHANISM AND DAMPING SYSTEM

PRIORITY CLAIM

This application claims priority to Provisional Application No. 60/433,315, filed on Dec. 13, 2002, which is hereby incorporated by reference.

BACKGROUND

The present invention relates generally to gas pressure driven fluid pumps. More particularly, the invention relates to such a pump utilizing a compression spring linkage to selectively open and close gas ports in a snap acting manner.

Condensate removal systems in steam piping arrangements often utilize gas pressure driven pumps that function without electrical power. As described in U.S. Pat. No. 5,938,409 to Radle (incorporated herein by reference), such a pump typically will have a tank with a liquid inlet and a liquid outlet. The liquid inlet and liquid outlet, which are located near the bottom of the tank, will be equipped with an inlet check valve and an outlet check valve to permit liquid flow only in the pumping direction. A pair of interconnected valves control a gas motive port and a gas exhaust port.

The pump operates by alternating between a liquid filling phase and a liquid discharge phase. During the liquid filling phase, the motive port is closed while the exhaust port is open. A float connected to a snap acting linkage rises with the level of liquid entering the tank. When the float reaches a high level position, the linkage snaps over to simultaneously open the motive port and close the exhaust port. As a result, the pump will switch to the liquid discharge phase.

In the liquid discharge phase, steam or other motive gas is introduced into the pump tank through the motive port. The motive gas forces liquid from the tank, thus causing the float to lower with the level of the liquid. When the float reaches a low level position, the linkage snaps over to simultaneously open the exhaust port and close the motive port. As a result, the pump will again be in the liquid filling phase.

While the snap acting linkage used in gas pressure driven pumps of the prior art generally has functioned well, there exists room in the art for additional snap acting valve arrangements.

SUMMARY OF THE INVENTION

The present invention recognizes and addresses the foregoing considerations, and others, of prior art constructions and methods.

In one aspect, the invention provides a gas pressure driven fluid pump. The pump comprises a pump tank having a liquid inlet and a liquid outlet. A float member carried within the interior of the tank moves between a low level position and a high level position.

A compression spring is provided with a first end operatively connected to the float member. A pivot member is operatively connected to the second end of the compression spring. The pivot member rotates to a first position in a snap-over manner when the float member reaches its high level position due to the force applied by the compression spring. The pivot member rotates to a second position in a snap-over manner when the float member reaches its low level position due to the force applied by the compression spring.

A valve assembly is connected to the pivot member. The valve assembly is switchable between motive porting and exhaust porting in a snap over fashion due to rotation of the pivot member between its first and second positions. The valve assembly moves to motive porting when the pivot member snaps-over to its first position and to exhaust porting when the pivot member snaps-over to its second position such that liquid will be alternately introduced into and discharged from the pump tank.

In another aspect of the invention, the pump contains a damping system operatively connected to the pivot member. The damping system slows movement of the valve assembly to reduce impact forces opening and closing valves. As a result, impact damage on the valves' sealing surfaces is largely eliminated and the sound level of the pump is reduced.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof to one of ordinary skill in the art, is set forth more particularly in the remainder of the specification, which makes reference to the accompanying drawings, in which:

FIG. 13 is a detailed view of the pivotal connection between the compression spring and pivot member;

FIG. 14 is a detailed side view similar to FIG. 11 but showing an alternative connection between the float and the compression spring;

Figure 1:
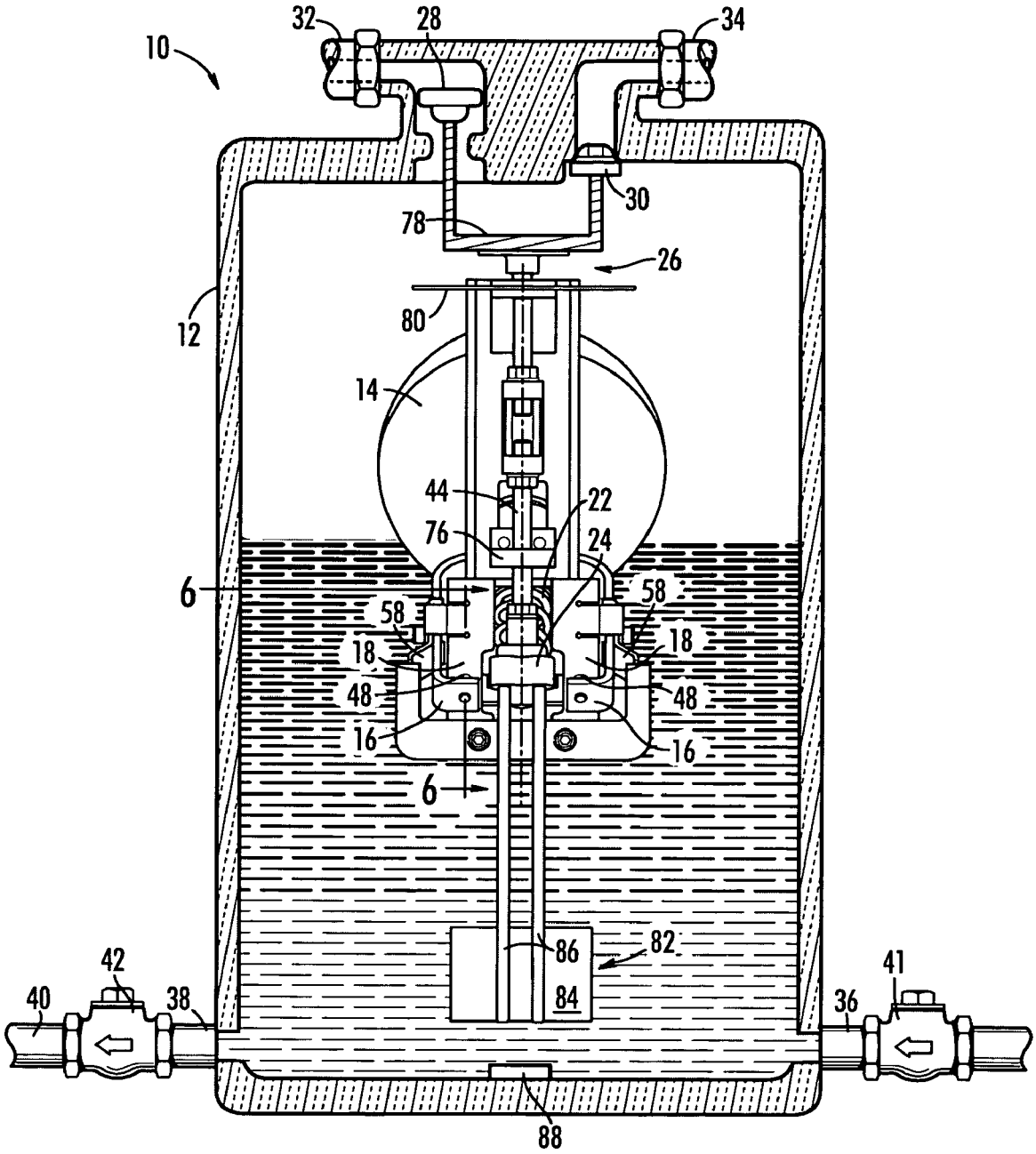
FIG. 1 is a rear cross-sectional view of the pump housing with the float in the high level position.

Repeat use of reference characters in the present specification and drawings is intended to represent same or analogous features or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention.

Figure 2:
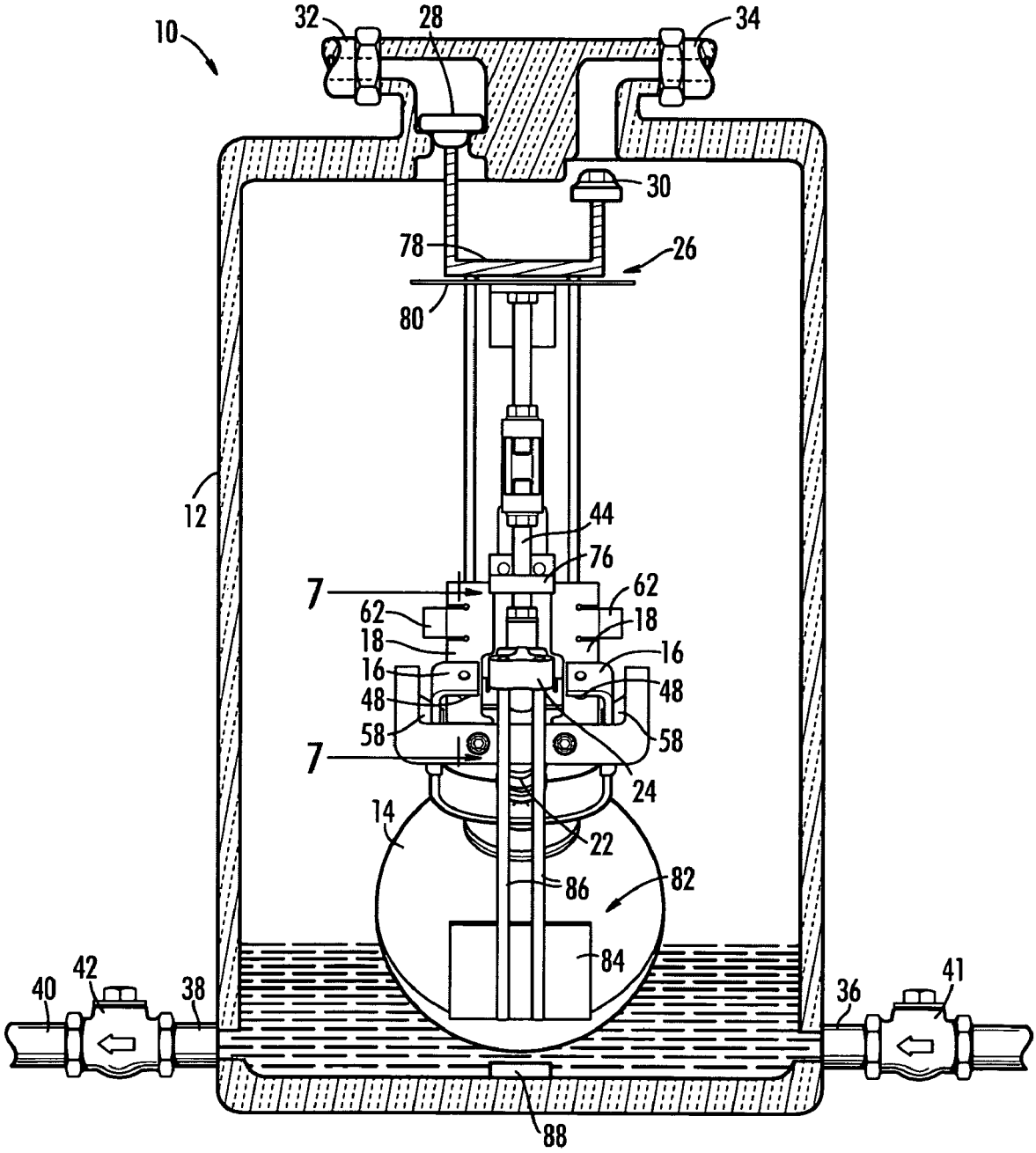
FIG. 2 is a view similar to FIG. 1 with the float in the low level position.

FIGS. 1 and 2 illustrate a pressure driven pump 10 constructed in accordance with the present invention. As shown, pump 10 has a tank 12 defining an interior in which a float 14 is located. Float 14 may be pressurized, thereby increasing buoyancy and lowering its weight. Such a pressurized float may advantageously prevent collapse under high pressure or water hammer.

Figure 3:
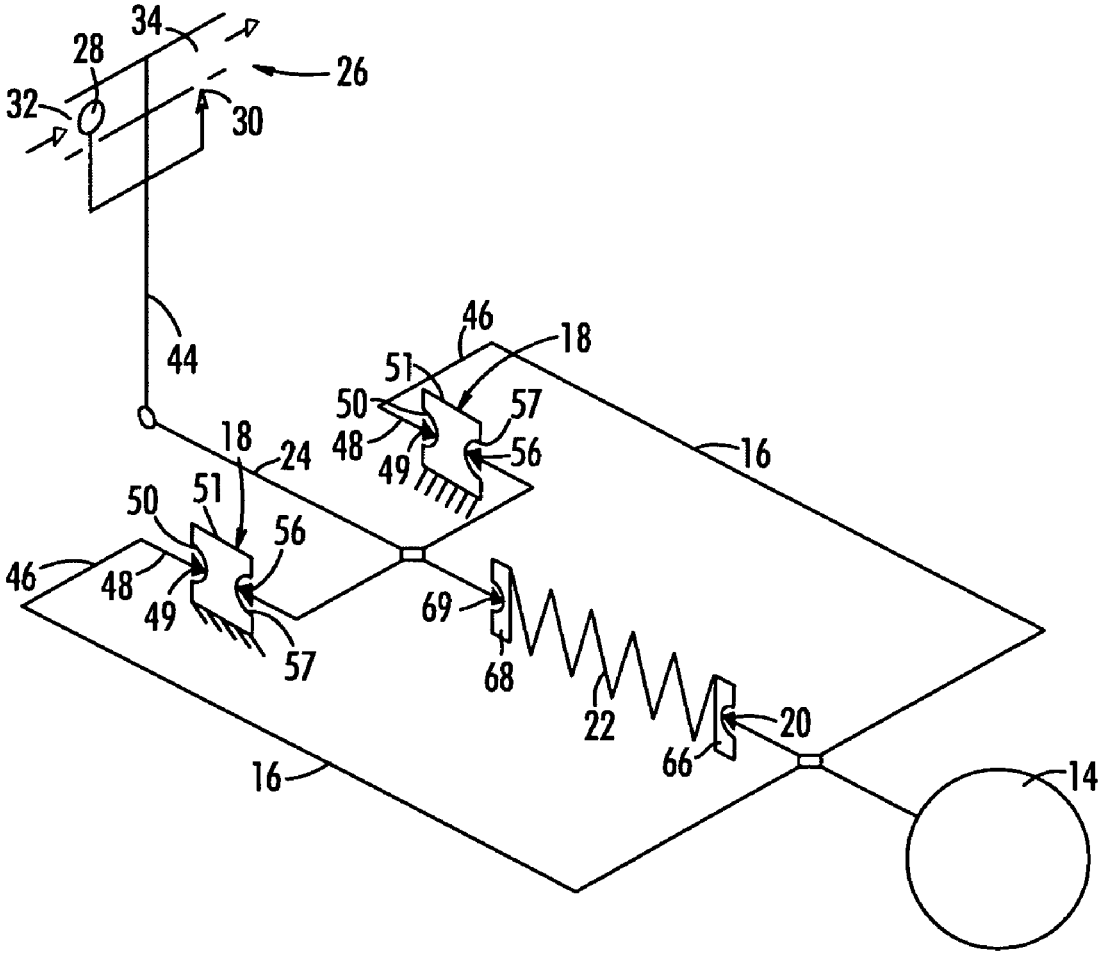
FIG. 3 is a schematic diagram of the valve assembly and compression spring pivot mechanism in accordance with one embodiment of the present invention.
Figure 4:
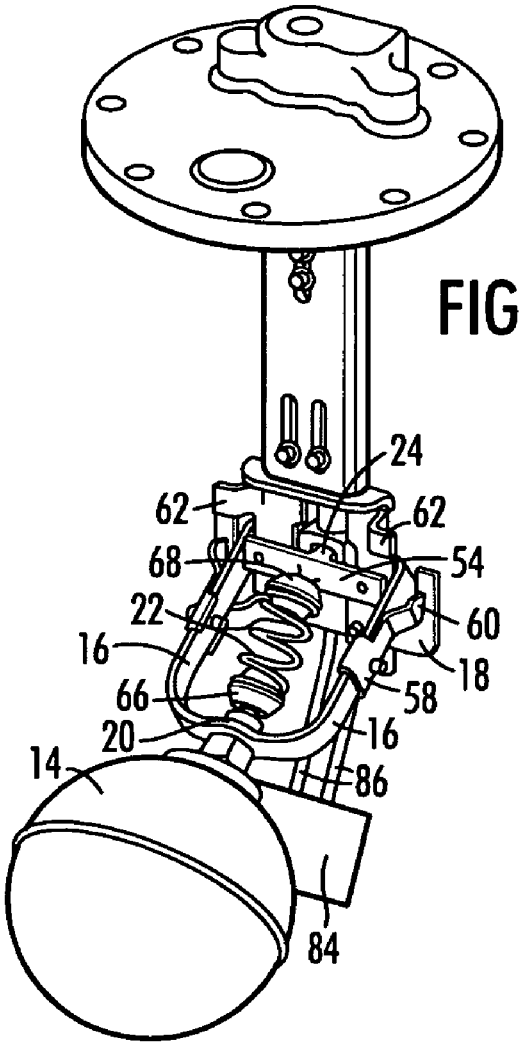
FIG. 4 is a front perspective view of the compression spring pivot mechanism of FIG. 1 with the float in the low level position.
Figure 5:
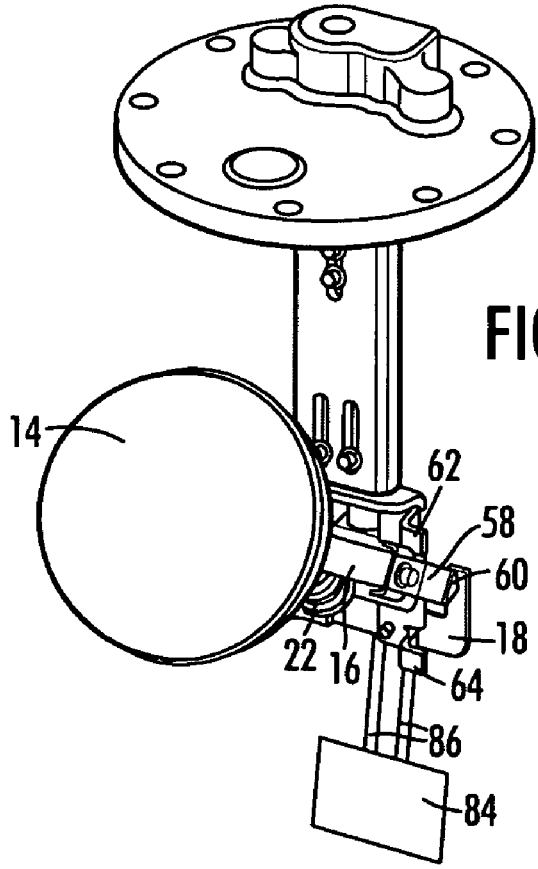
FIG. 5 is a view similar to FIG. 4 with the float in the high level position.
Figure 22:
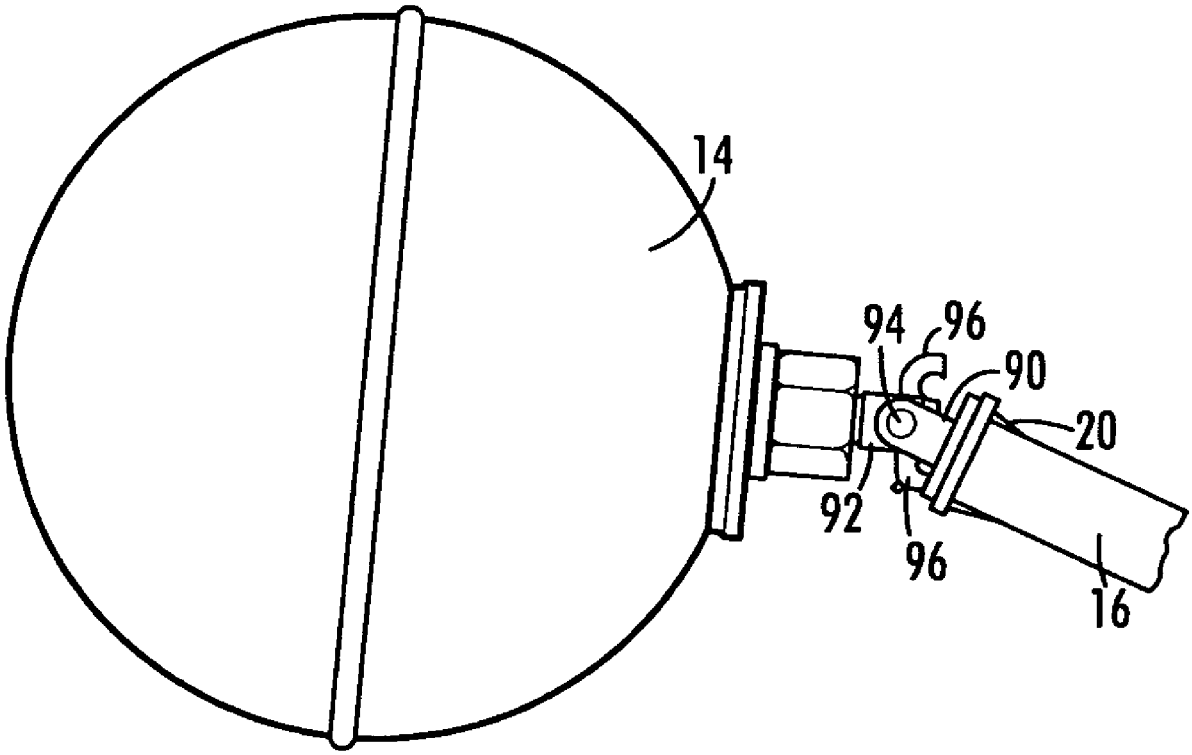
FIG. 22 shows an articulated connection between float and float arms according to an embodiment of the present invention.

Referring now also to FIG. 3, float 14 is rigidly connected to a pair of float arms 16 that are pivotally attached to a support frame 18. A spud 20, also connected to float 14, is operatively connected to one end of a compression spring 22. Although spud 20 is rigidly connected to float 14 and float arms 16 in the embodiment shown, it should be appreciated that the connection between float 14 and float arms 16 could be articulated as shown in FIG. 22 and described below to allow some free movement of float 14.

The opposite end of compression spring 22 is pivotally connected to a pivot member 24 controlling a push rod 44. In turn, push rod 44 is connected to a valve assembly 26. Valve assembly 26 controls the operation of a motive valve 28 and an exhaust valve 30.

Valves 28 and 30, respectively, function to introduce motive gas into and exhaust gas out of the interior of tank 12 based on the position of float 14. Toward this end, a motive pipe 32 is connected between motive valve 28 and a source of motive gas, such as a source of steam. Similarly, a balance pipe 34 is connected between exhaust valve 30 and a suitable sink to which gas inside of tank 12 can be exhausted. In some cases, for example, balance pipe 34 can terminate such that the gas will simply exhaust to the ambient atmosphere.

Figure 21:
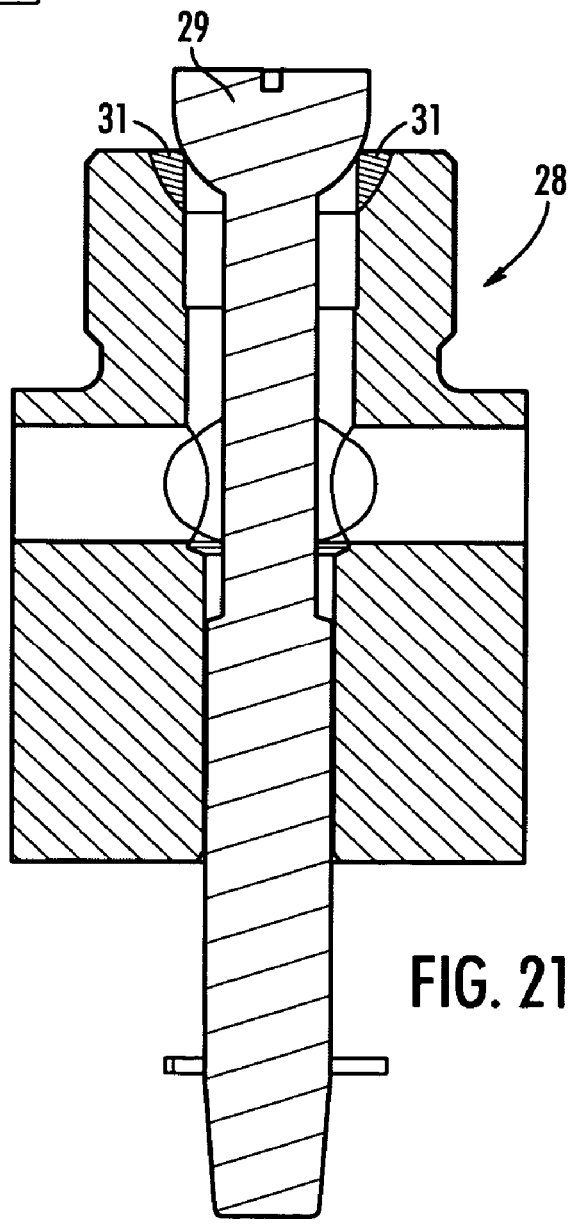
FIG. 21 is a detailed side cross-section view of an exemplary valve having a hardened metallic alloy on its valve seat according of an embodiment of the present invention.

In one embodiment, valves 28 and 30 have a suitable alloy formed on each valve seat to increase durability. For example, a product sold under the name STELLITE by Stoody Deloro Stellite, Inc. of St. Louis, Mo., would be a suitable alloy for the seats of valves 28 and 30. In FIG. 21, for example, an embodiment of motive valve 28 having a valve stem 29 that contacts a seat 31 formed from a hard metallic alloy is shown.

As shown in FIGS. 1 and 2, tank 12 defines a liquid inlet 36 through which the liquid to be pumped is introduced. Tank 12 further defines a liquid outlet 38 through which the liquid passes when pumped into return line 40. Respective check valves 41 and 42 are provided at liquid inlet 36 and liquid outlet 38 so that the liquid flows in only the desired direction.

When tank 12 is emptied, float 14 will fall to the low level position shown in FIG. 2. Upon reaching the low level position, force from compression spring 22 rotates pivot member 24 in a snap over manner to its exhaust position. In other words, the rotation of pivot member 24 moves push rod 44 to simultaneously switch motive valve 28 and exhaust valve 30 in a snap over manner from motive porting to exhaust porting. During exhaust porting, exhaust valve 30 is open to allow fluid communication between the interior of tank 12 and balance pipe 34; motive valve 28, however, is closed to block fluid communication between motive pipe 32 and tank 12. It should be appreciated by one of ordinary skill in the art that various types of valves could be used for motive valve 28 and exhaust valve 30.

At the beginning of the liquid filling phase, liquid will begin flowing into tank 12 when the pressure is sufficient to overcome the pressure drop across check valve 41. If the pressure of the liquid is high enough, it will continue through check valve 42 and into return line 40. When the back pressure in return line 40 exceeds the pressure in the interior of tank 12, however, the liquid will begin to fill tank 12. As the level of the liquid rises, so does float 14. The positions of motive valve 28 and exhaust valve 30, however, do not change when float 14 is rising.

When float 14 reaches the high level position, as shown in FIG. 1, the force of compression spring 22 rotates pivot member 24 in a snap over manner to its motive position. In other words, push rod 44 moves to simultaneously switch motive valve 28 and exhaust valve 30 in a snap over manner from exhaust porting to motive porting. During motive porting, motive valve 28 allows fluid communication between the interior of tank 12 and motive pipe 32. Motive gas thus introduced into tank 12 will force the liquid through liquid outlet 38 and into return line 40. Float 14 drops along with the level of the liquid within tank 12. The positioning of motive valve 28 and exhaust valve 30 remains the same, however, until float 14 reaches the low level position. When float 14 eventually falls to the low level position, the pumping cycle will begin again. As used herein, the terms "low level position" and "high level position" are intended to indicate the float positions at which snap-over occurs. As one skilled in the art would recognize, these positions are approximately the same as, but not necessarily identical to the positional extremes to which the float will travel.

The pivoting operation of float arms 16 and pivot member 24 will now be described with reference to FIGS. 3 through 8. Each float arm 16 has a distal end with a lateral member 46 having a pivot element 48. Each such pivot element 48 includes a tip portion 49 received in a corresponding socket 50 defined in bushing 51. Bushing 51 is, in turn, fixed to support frame 18.

Accordingly, lateral members 46 of float arms 16 are pivotally connected to the rear of support frame 18 and may pivot freely within socket 50 of bushing 51. The small area of contact between the tip portions 49 of each pivot element 48 and bushing 51 provides minimal friction, thereby reducing failure of these components. It should be appreciated that pivot elements 48 and bushing 51 may preferably be formed from high wear resistant materials, such as tungsten carbide or stainless steel.

Figure 6:
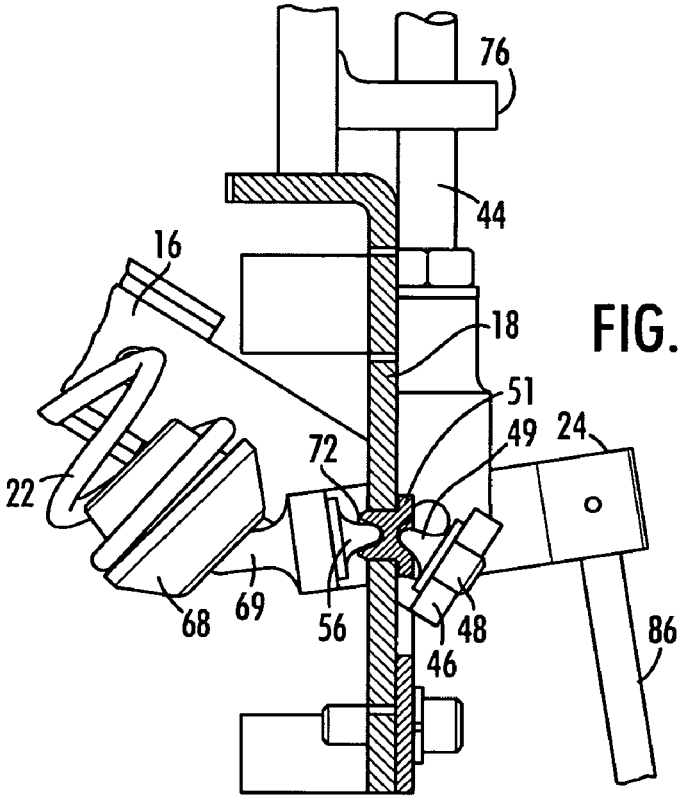
FIG. 6 is a detailed side cross-sectional view of the compression spring linkage along line 6—6 of FIG. 1.
Figure 7:
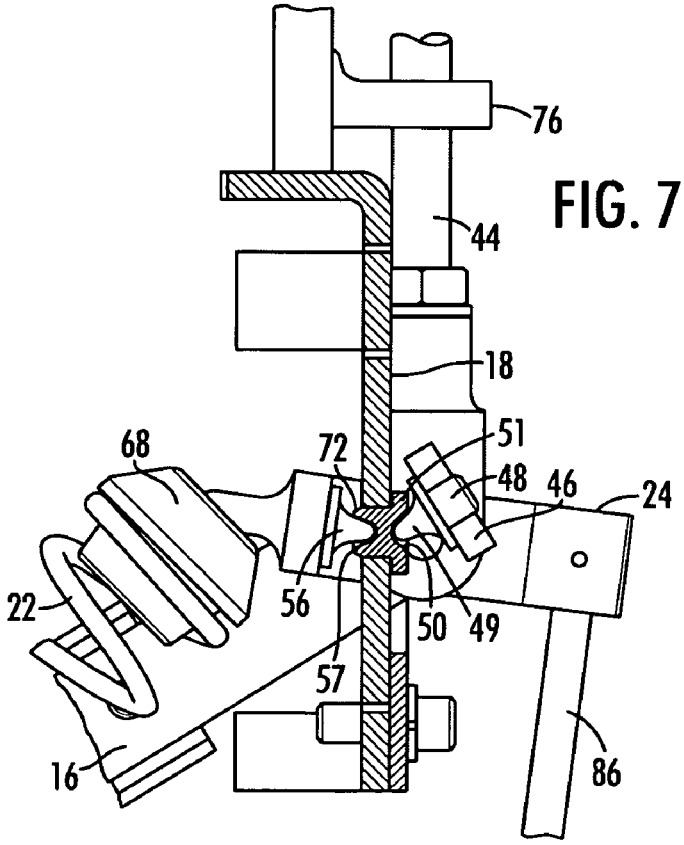
FIG. 7 is a detailed side cross-sectional view of the compression spring linkage along line 7—7 of FIG. 2.
Figure 8:
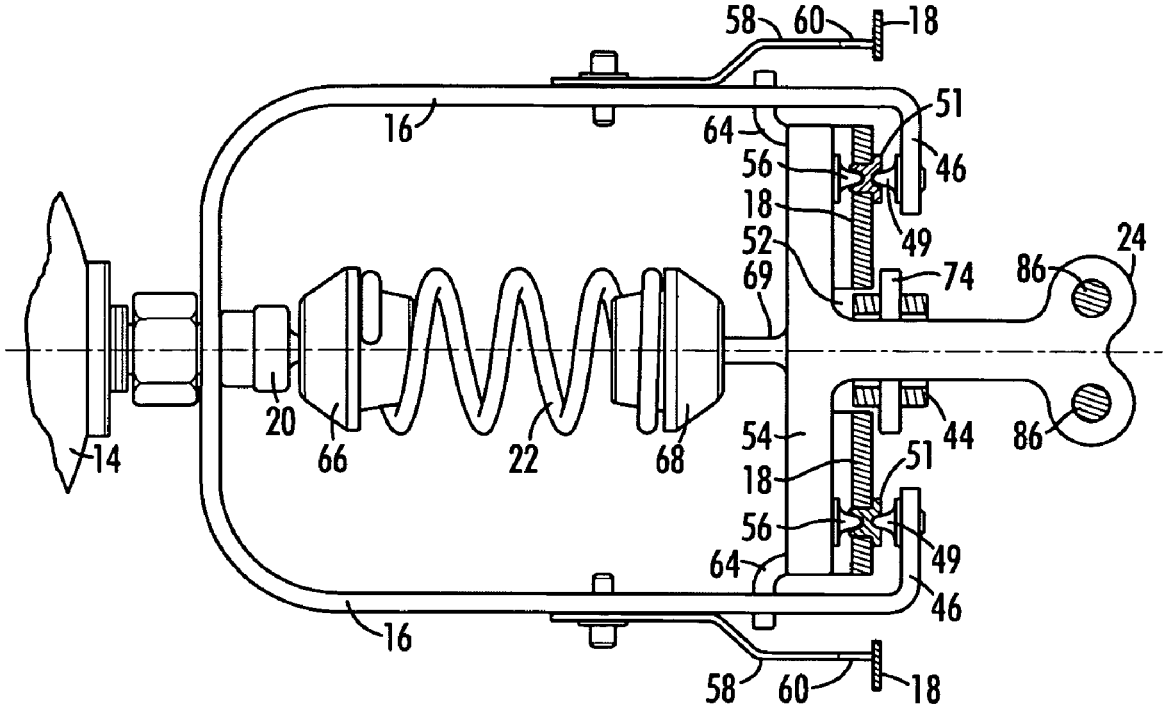
FIG. 8 is a top plan view of the compression spring pivot mechanism of FIG. 1.
Figure 9:
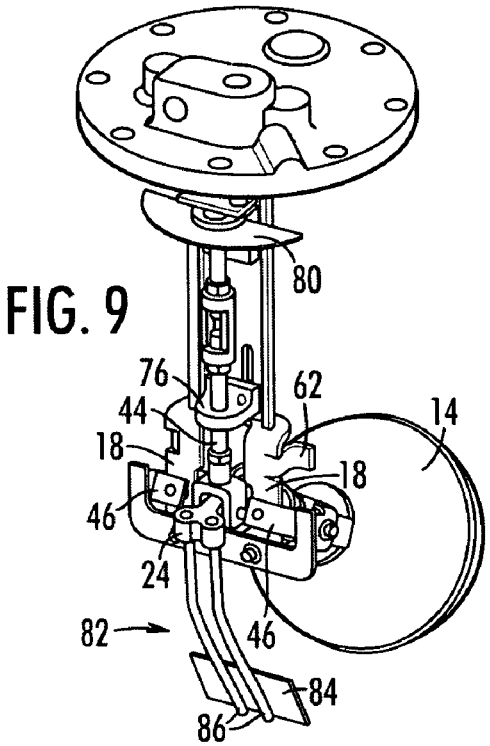
FIG. 9 is a rear perspective view of the compression spring pivot mechanism of FIG. 1 with the float in the low level position.

Support frame 18 contains an opening 52 (FIG. 8) through which pivot member 24 extends. As best shown in FIG. 8, pivot member 24 contains a planar portion 54 on the float side ("front") of support frame 18. A pair of pivot elements 56 are carried by planar portion 54 of pivot member 24, as shown. Pivot elements 56 are each received in corresponding sockets 57 defined in bushings 51. As seen in FIGS. 6 and 7, pivot member 24 and float arms 16 thus pivot in oppositely-directed sockets of bushing 51, located respectively on the front and rear of support frame 18.

Figure 10:
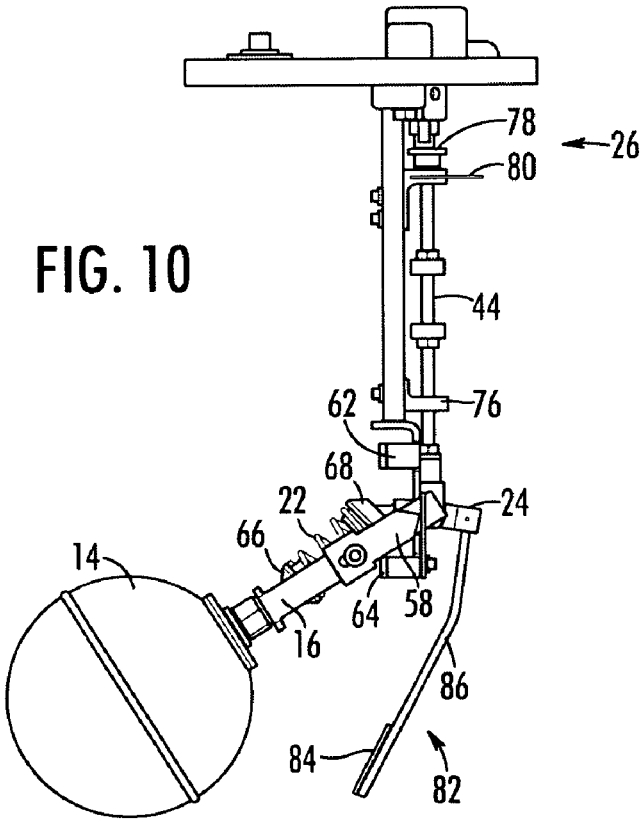
FIG. 10 is a side view of the compression spring pivot mechanism of FIG. 1 with the float in the low level position.

Referring again to FIG. 8, a support member 58 also extends from each float arm 16 in the illustrated embodiment. Each support member 58 defines a tapered pivot point 60 (see FIGS. 4 and 5) that makes contact with and pivots with respect to support frame 18, thereby facilitating assembly of the pump and reducing lateral movement of float arms 16. An upper stop 62 and lower stop 64 (FIG. 10) are fixed to support frame 18 so as to limit the range of rotation of float arms 16, thus desirably restricting the range of movement of float 14.

Figure 12:
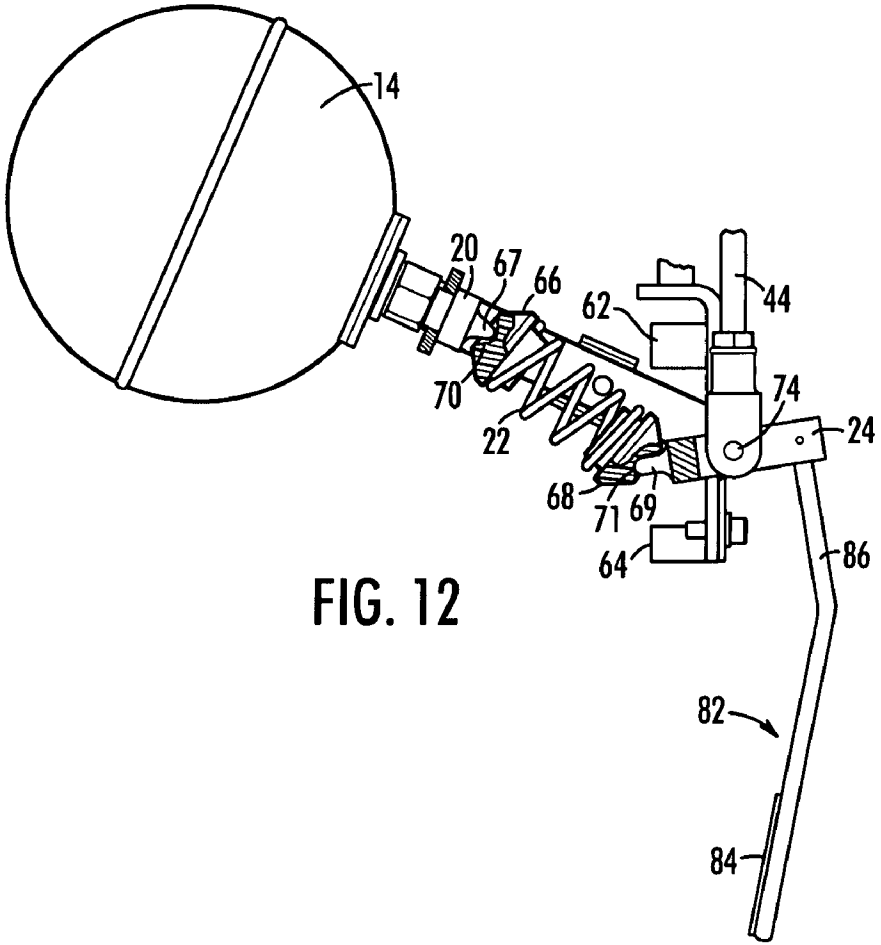
FIG. 12 is a detailed side view similar to FIG. 11 with the float in the high level position.
Figure 11:
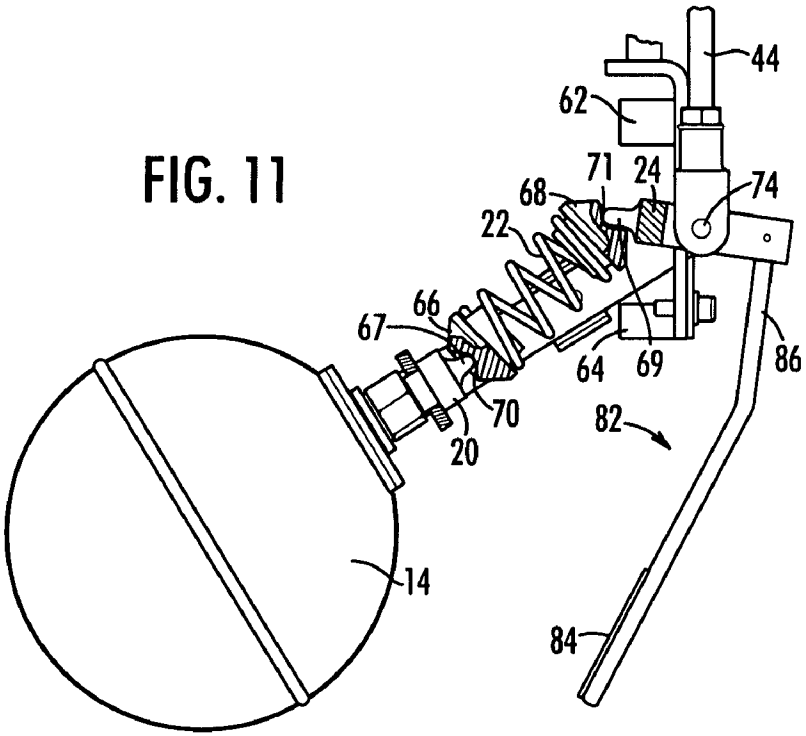
FIG. 11 is a detailed side view of the compression spring linkage mechanism (partially in section) with the float in the low level position.

Referring to FIGS. 11 through 13, compression spring 22 is disposed between a first anchor 66 and a second anchor 68. (In lieu of anchor 66, this end of compression spring 22 may be affixed to float 14 as shown in FIG. 14). Spud 20 is operatively connected to first anchor 66 while planar portion 54 of pivot member 24 is operatively connected to second anchor 68 (see FIG. 8).

Specifically, first anchor 66 and second anchor 68 define respective sockets 70 and 71 that receive tip portion 67 of spud 20 and tip portion 69 of pivot member 24. As float 14 moves between the low level and high level positions, tip portions 67 and 69 move within the respective sockets 70 and 71. The contact area between tip portions 67 and 69 and the corresponding socket 70 or 71 is relatively small, thereby reducing friction.

It should be appreciated that the engaging portions of spud 20, pivot member 24 and anchors 66 and 68 may preferably be formed from suitable high wear resistant materials, such as tungsten carbide or stainless steel.

Figure 16:
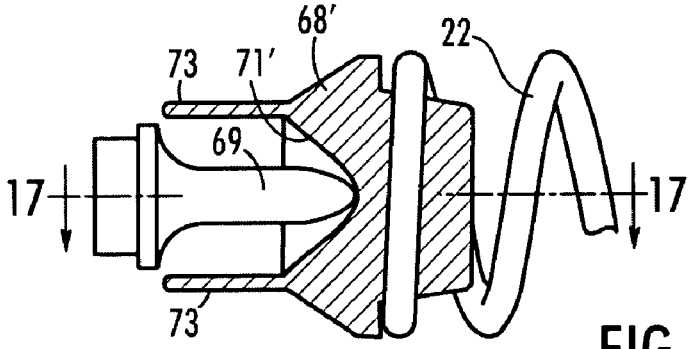
FIG. 16 is a detailed top view, partially in section, showing the pivotal connection between the compression spring and pivot member in accordance with an alternative embodiment.
Figure 17:
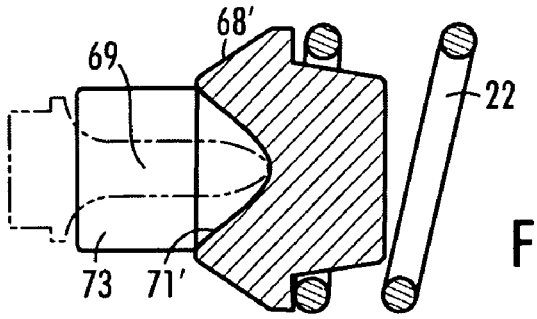
FIG. 17 is a detailed side cross-sectional view of the pivotal connection between the compression spring and pivot member along line 17—17 of FIG. 16.
Figure 18:
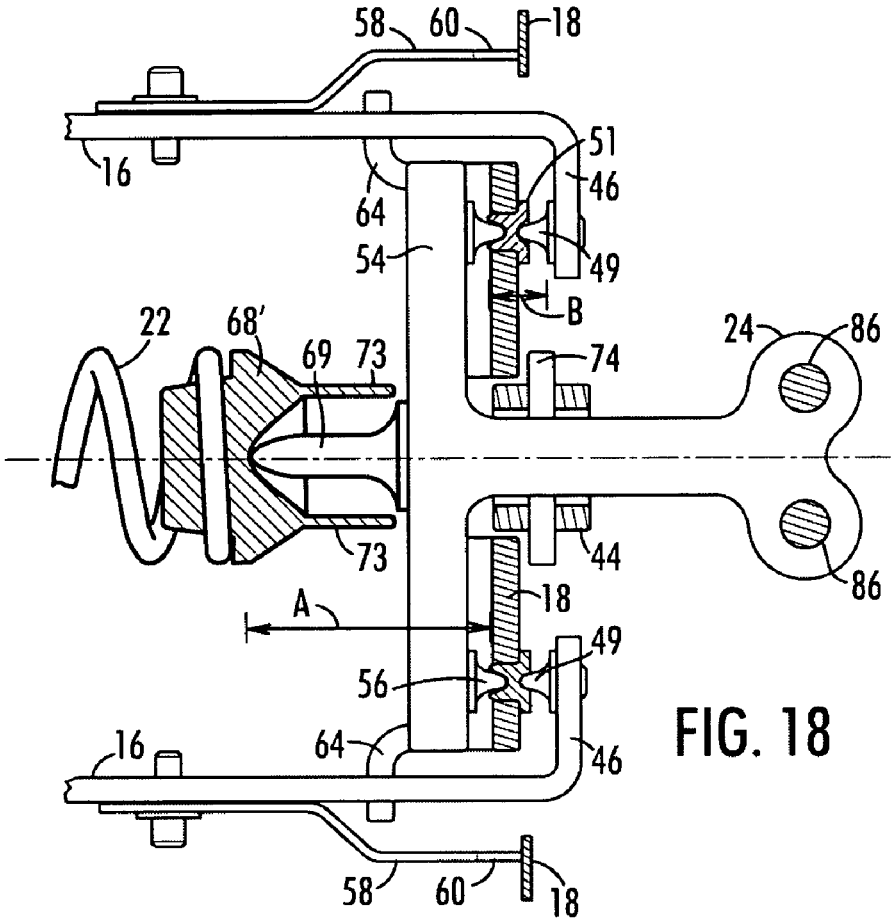
FIG. 18 is a detailed top cross-sectional view of the compression spring linkage mechanism in accordance with the embodiment of FIG. 16.

In some exemplary embodiments, anchors 66 and 68 may be provided with side walls to reduce lateral movement of the corresponding tip portion, which could cause them to become unseated from their respective sockets 70 and 71. As shown in FIGS. 16 through 18, for example, anchor 68' has side walls 73 protruding from each side of socket 71'. Side walls 73 maintain tip portion 69 of pivot member 24 within socket 71' of anchor 68 during pivoting.

In many embodiments, compression spring 22 may be held in place between spud 20 and pivot member 24 simply by its compression force. It should be appreciated, however, that anchors 66 and 68 may be connected to spud 20 and pivot member 24 using a pin or other suitable connection that allows the desired relative movement.

When float 14 reaches either threshold position, the force of compression spring 22 is sufficient to rotate pivot member 24 in a snap over manner about fulcrum 72 (pivot point about bushings as shown in FIGS. 6 and 7). When float 14 reaches the high level position, pivot member 24 rotates to its motive position as shown in FIG. 12. Pivot member 24 rotates to its exhaust position when float 14 reaches the low level position, as shown in FIG. 11.

Pivot member 24 is pivotally connected to push rod 44 via a pin 74. The pivot point between pivot member 24 and push rod 44 is offset from fulcrum 72 by a predetermined distance such that rotation of pivot member 24 causes vertical movement of push rod 44 along its longitudinal axis. When float 14 reaches the low level position, push rod 44 travels in a first direction along its longitudinal axis (downward as shown in FIG. 2). When float 14 reaches the high level position, however, push rod 44 moves in an opposite direction along its longitudinal axis (upward as shown in FIG. 1). A guide 76 (FIGS. 6 and 7) may be provided to direct push rod 44 along a proper path.

Referring now to FIG. 18, the relative distance between the engaging end of tip portion 69 and fulcrum 72 compared with the distance between pin 74 and fulcrum 72 can be configured to provide a mechanical advantage. In this illustrative embodiment, for example, the distance between the engaging end of tip portion 69 and fulcrum 72 is designated as "A." The distance between pin 74 and fulcrum 72 is designated as "B." Because the distance "A" is greater than distance "B," less force can be applied on the engaging end of tip portion 69 to move pin 74. This permits the use of a "lighter" spring than may otherwise be required.

Figure 19:
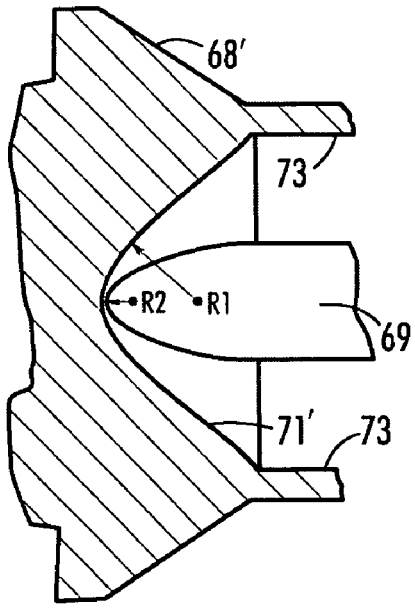
FIG. 19 is a detailed side cross-sectional view of the tip portion of the pivot member and the anchor in accordance with exemplary embodiments.
Figure 20:
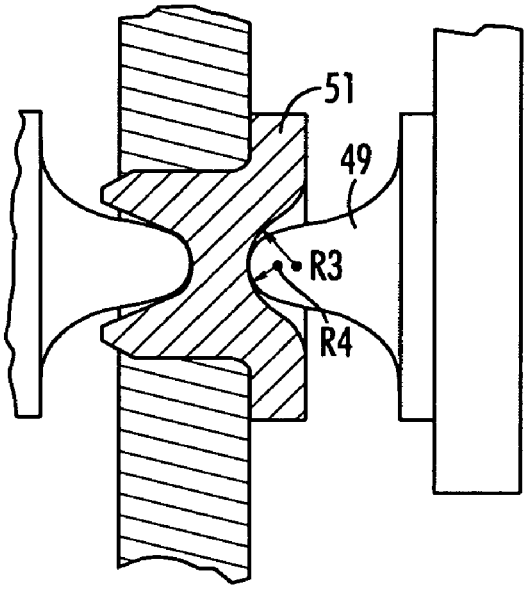
FIG. 20 is a detailed side cross-sectional view of the tip portion of the pivot element and the bushing in accordance with exemplary embodiments.

Preferably, the various tip portions and their corresponding sockets will be sized to facilitate relative movement and minimal friction therebetween. As shown in FIG. 19, for example, tip portion 69 has a radius designated R2 while the radius of socket 71' of anchor 68' is designated as R1. By way of another example in FIG. 20, the radius of tip portion 49 is designated R4 while the radius of the socket of bushing 51 receiving tip portion 49 is designed as R3. It can be seen that the radius R1 is greater than the radius R2 to allow pivotal movement between pivot member 24 and anchor 68'. Likewise, the radius R3 is greater than the radius R4 to allow pivotal movement between bushing 51 and pivot element 48.

Preferably, tip portions 49 and 69 have as small of a radius as possible while preventing possible breakage of tip portions 49 and 69. In one preferred embodiment, R1 has a range of approximately 0.047 inches to 0.063 inches while R2 has a range of approximately 0.030 to 0.047 inches. In another exemplary embodiment, R3 has a range of approximately 0.047 inches to 0.063 inches while R4 has a range of approximately 0.030 to 0.047 inches. Accordingly, the small radius of tip portion 69 will reduce friction between pivot member 24 and anchor 68', thereby increasing the life of both anchor 68 and pivot member 24. Likewise, the small radius of tip portion 49 will reduce friction between pivot element 48 and bushing 51, thereby increasing the life of both pivot element 48 and bushing 51.

Referring again to FIGS. 1 and 2, push rod 44 is attached to an actuator plate 78, such that movement of push rod 44 also moves actuator plate 78. One of ordinary skill in the art should recognize that push rod 44 and actuator plate 78 can be constructed as a unitary member, or can be two pieces that are connected together or that otherwise move in unison.

As shown, actuator plate 78 is connected to both motive valve 28 and exhaust valve 30. Thus, movement of actuator plate 78 controls the porting of motive valve 28 and exhaust valve 30. As seen in FIG. 2, motive valve 28 is closed and exhaust valve 30 is open when actuator plate 78 rests on stop 80. However, motive valve 28 is open and exhaust valve 30 is closed when actuator plate 78 is in the elevated position shown in FIG. 1. Stop 80 limits downward movement of actuator plate 78 while upward movement is limited by exhaust valve 30.

A damping system 82 may be provided to reduce impact forces of opening and closing valves 28 and 30. In this embodiment, damping system 82 includes a plate 84 rigidly connected to pivot member 24. The drag caused by movement of plate 84 through the liquid in tank 12 slows movement of push rod 44. As a result, impact damage on the sealing surfaces of valves 28 and 30 is largely eliminated. Moreover, damping system 82 reduces the sound level of pump 10 in operation.

As shown, a pair of shafts 86 connect plate 84 to pivot member 24 in this embodiment. It should be appreciated, however, that a single shaft or other suitable connector could also be utilized to attach plate 84 to pivot member 24. Moreover, embodiments are contemplated in which plate 84 and pivot member 24 are constructed as an integral member.

As also shown in FIGS. 1 and 2, a magnet 88 may be located within tank 12 to attract ferrous oxides suspended within the liquid. As a result, the presence of harmful debris within tank 12 is greatly reduced.

Further details regarding the operation of the compression spring mechanism will now be described with reference to FIGS. 1–2 and 11–13. As liquid begins flowing into tank 12, float 14 rises. The movement of float 14 causes tip portions 67 and 69 to rotate within the respective sockets 70 and 71 of anchors 66 and 68. However, pivot member 24 will not rotate to its motive position until float 14 reaches the high level position. Thus, the position of motive valve 28 and exhaust valve 30 also remains the same.

When float 14 reaches the high level position, the force exerted upon pivot member 24 by compression spring 22 is sufficient to rotate pivot member 24 in a snap over manner to its motive position as shown in FIG. 12. The rotation of pivot member 24 moves push rod 44 upward along its longitudinal axis. In the motive position, as seen in FIG. 1, actuator plate 78 is elevated, thereby placing motive valve 28 in an open position and exhaust valve 30 in a closed position. Motive valve 28 thus allows fluid communication between the interior of tank 12 and motive pipe 32 (while exhaust valve 30 prevents fluid communication between balance pipe 34 and tank 12).

As liquid exits tank 12, float 14 falls with the liquid level within tank 12. The movement of float 14 causes tip portions 67 and 69 to rotate within sockets 70 and 71 of anchors 66 and 68. However, pivot member 24 does not rotate to its exhaust position until float 14 reaches the low level position. Thus, the position of motive valve 28 and exhaust valve 30 also remains the same.

When float 14 reaches the low level position, the force exerted upon pivot member 24 by compression spring 22 is sufficient to rotate pivot member 24 in a snap over manner to its exhaust position as shown in FIG. 11. The rotation of pivot member 24 moves push rod 44 downward along its longitudinal axis. In the exhaust position, as seen in FIG. 2, actuator plate 78 rests on stop 80, thereby placing exhaust valve 30 in an open position and motive valve 28 in a closed position. Exhaust valve 30 thus allows fluid communication between the interior of tank 12 and balance pipe 34 (while motive valve 28 prevents fluid communication between motive pipe 32 and tank 12). When liquid filling tank 12 causes float 14 to reach the high level position, the pumping cycle will begin again.

Figure 15:
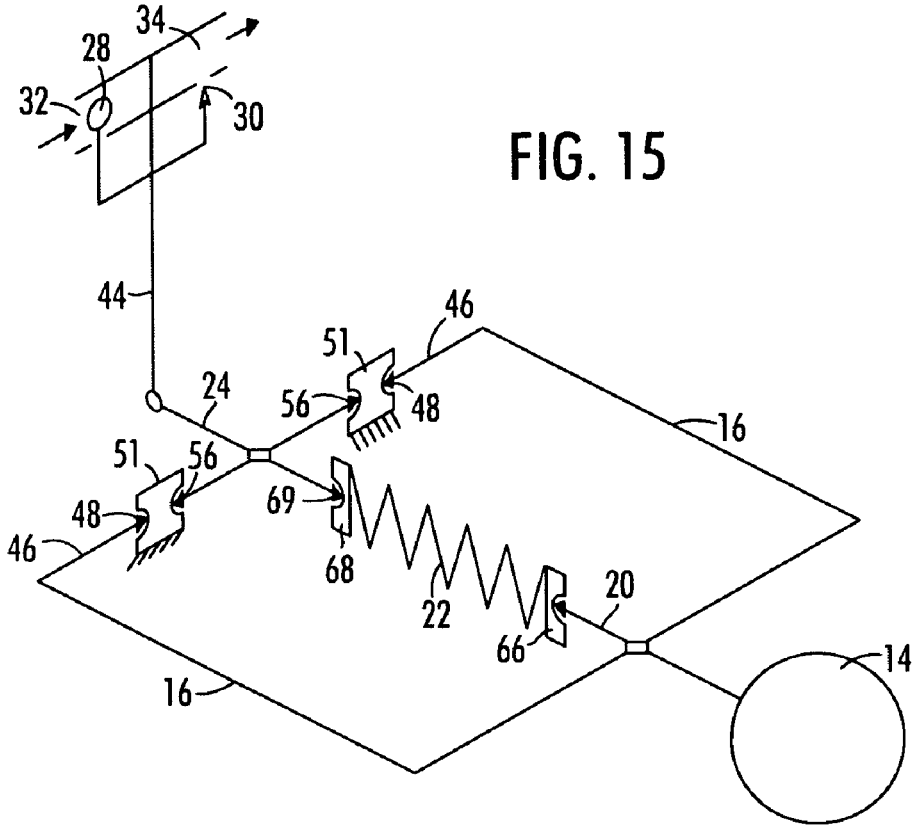
FIG. 15 is a schematic diagram of an alternative embodiment of the compression spring pivot mechanism.

An alternative embodiment is schematically illustrated in FIG. 15. In this embodiment, the pivot sockets of bushing 51 are rotated approximately 90 degrees in comparison with the previous embodiment. The operation of this embodiment is otherwise substantially the same as that described above.

An alternative connection between float 14 and float arms 16 is shown in FIG. 22. Instead of a rigid connection, float 14 is pivotally connected to float arms 16 to allow some free movement of float 14. Such an articulated connection minimizes the physical travel of pivots and anchors, but still achieves the same stroke or swept volume. In the embodiment shown, float arms 16 have a U-shaped extension 90 to which float 14 is connected. A projection 92 extends from float 14 and has a hole that is aligned with a hole in extension 90. A pin 94 is placed through holes in extension 90 and projection 92 to form a pivotal connection. In some embodiments, stops 96 may be provided to limit the range through which float 14 can pivot. It should be appreciated that other suitable pivot arrangements could be used to connect float 14 and float arms 16.

It can thus be seen that the present invention provided an improved spring actuated mechanism for use with a gas pressure driven pump. It has been found that the use of high wear resistant materials, such as tungsten carbide, extends the life of components to over three million cycles.

One skilled in the art will also appreciate that the compression spring linkage of the present invention could be utilized in various applications other than a gas pressure driven pump. In such applications, the mechanism could be operated by various devices and mechanisms (e.g., by hand, float, electric, pneumatic, etc.).

It should also be understood that aspects of the various embodiments may be interchanged both in whole or in part. Furthermore, those of ordinary skill in the art will appreciate that the foregoing description is by way of example only, and is not intended to be limitative of the invention described in the appended claims.

What is claimed is:

1. A gas pressure driven fluid pump, said pump comprising:

a pump tank having a liquid inlet and a liquid outlet;

a float assembly including a buoyant float carried within the interior of said pump tank, said float being operable to move between a low level position and a high level position;

a compression spring having a first end and a second end, said first end being operatively connected to said float assembly;

an anchor located at said second end of said compression spring, said anchor having a socket;

a pivot member operatively connected to said second end of said compression spring via a tip portion engaging said socket of said anchor, said pivot member rotating to a first position when said float reaches said high level position and said pivot member rotating to a second position when said float reaches said low level position; and a valve assembly connected to said pivot member, said valve assembly being switchable between motive porting and exhaust porting in a snap over fashion due to rotation of said pivot member between said first position and said second position.

2. The pump as recited in claim 1, wherein at least one wall protrudes from the periphery of said socket so as to prevent lateral disengagement by said tip portion.

3. The pump as recited in claim 1, wherein said tip portion is formed from tungsten carbide.

4. The pump as recited in claim 1, wherein said float assembly includes a pair of float arms pivotally connected to a stationary support structure.

5. The pump as recited in claim 4, further comprising a support member extending from each of said float arms.

6. The pump as recited in claim 4, wherein said compression spring is positioned between said float arms.

7. The pump as recited in claim 4, further comprising an anchor located at said first end of said compression spring, said anchor having a socket that is engaged by a tip portion fixed with respect to said float arms.

8. The pump as set forth in claim 4, wherein said float is connected to said float arms via an articulated connection.

9. The pump as recited in claim 1, further comprising a magnet situated within said tank so as to attract ferrous material within the fluid.

10. The pump as recited in claim 1, wherein said float is pressurized.

11. The pump as recited in claim 1, wherein said pivot member rotates between said first position and said second position about a fulcrum and said valve assembly has a push rod, said push rod being pivotally connected to said pivot member at a location offset from said fulcrum.

12. The pump as recited in claim 11, wherein said pivot member is dimensioned such that a first distance is defined between said fulcrum and a distal end of said tip portion of said pivot member is greater than a second distance defined between said fulcrum and the pivotal connection between said push rod and said pivot member.

13. The pump as recited in claim 11, wherein rotational movement of said pivot member causes movement of said push rod along its longitudinal axis.

14. The pump as recited in claim 11, further comprising a guide for controlling the path of said push rod.

15. The pump as recited in claim 1, wherein said valve assembly includes a motive valve connected between said pump tank and a source of motive gas and an exhaust valve connected between said tank and a sink, both said motive valve and said exhaust valve being operatively interconnected such that one will be open while the other is closed.

16. The pump as recited in claim 1, further comprising an upper stop for limiting upward movement of said float assembly from extending beyond said high level position.

17. The pump as recited in claim 1, further comprising a lower stop for limiting downward movement of said float assembly from extending beyond said low level position.

18. The pump as recited in claim 1, wherein said tip portion has a radius in the range of approximately 0.030 inches to approximately 0.047 inches.

19. The pump as recited in claim 18, wherein said socket has a radius in the range of approximately 0.047 inches to approximately 0.063 inches.

20. The pump as recited in claim 1, wherein said valve assembly has a valve seat formed from a hardened metallic alloy.

21. The pump as recited in claim 1, wherein said first end of said compression spring is affixed with respect to said float assembly.

22. The pump as recited in claim 1, wherein said pivot member includes a pivot element engaging a socket located on a fixed support frame.

23. The pump as recited in claim 22, wherein said pivot member includes a pair of spaced apart pivot elements engaging respective sockets located on said support frame.

24. The pump as recited in claim 23, wherein said spaced apart pivot elements extend in an axial direction opposite to said tip portion of said pivot members which engages said anchor.

25. The pump as set forth in claim 23, wherein said sockets located on said support frame are defined in respective bushings.

26. The pump as set forth in claim 25, wherein each of said bushings defines first and second sockets on opposite sides thereof.

27. The pump as set forth in claim 26, wherein said first socket of each said bushing is engaged by said pivot element of said pivot member and said second socket of each said bushing is engaged by a pivot element of a respective float arm.

28. A gas pressure driven fluid pump, said pump comprising:

a pump tank having a liquid inlet and a liquid outlet;

a float assembly including a buoyant float carried within the interior of said pump tank, said float being operable to move between a low level position and a high level position;

a compression spring having a first end and a second end, said first end being operatively connected to said float assembly;

a pivot member operatively connected to said second end of said compression spring, said pivot member rotating to a first position when said float reaches said high level position and said pivot member rotating to a second position when said float reaches said low level position;

a valve assembly connected to said pivot member, said valve assembly being switchable between motive porting and exhaust porting in a snap over fashion due to rotation of said pivot member between said first position and said second position; and a damper system operatively connected to said pivot member.

29. The pump as recited in claim 28, wherein said damper system comprises a plate attached to said pivot member.

30. A gas pressure driven fluid pump, said pump comprising:

a pump tank having a liquid inlet and a liquid outlet;

a float assembly including a buoyant float carried within the interior of said pump tank, said float assembly being operable to move between a low level position and a high level position;

a valve assembly operatively connected to said float, said valve assembly being switchable between motive porting and exhaust porting in a snap over fashion due to rotation of said float between said high level position and said low level position; and a damper system operatively connected to said valve assembly, said damper system slowing movement of said valve assembly to said motive porting and said exhaust porting.

31. The pump as recited in claim 30, wherein said damper system comprises a plate configured to create a drag through liquid in said tank.

32. The pump as recited in claim 30, further comprising a magnet located within said tank.

33. A gas pressure driven fluid pump, said pump comprising:

a pump tank having a liquid inlet and a liquid outlet;

means for detecting a low liquid level within said pump tank and a high liquid level within said pump tank;

a valve assembly operatively connected to detecting means, said valve assembly being switchable between motive porting and exhaust porting in a snap over fashion responsive to said detecting means;

a damper system operatively connected to said valve assembly, said damper system slowing movement of said valve assembly to said motive porting and said exhaust porting; and said valve assembly moving to said motive porting when said detecting means detects a high liquid level within said pump tank and to exhaust porting when said detecting means detects a low liquid level within said pump such that liquid will be alternately introduced into and discharged from said pump tank.

* * * * *